US005277011A

United States Patent [19]

Serrano Martin

[11] Patent Number: 5,277,011

[45] Date of Patent: Jan. 11, 1994

[54] WATERTIGHT ROOF FOR BUILDINGS AND CONSTRUCTIONS IN GENERAL

[76] Inventor: Jose A. Serrano Martin, Ctra. Nacional, 152, Km. 25, 6, 08400 Granollers (Barcelona), Spain

[21] Appl. No.: 911,904

[22] Filed: Jul. 10, 1992

[30] Foreign Application Priority Data

Jul. 12, 1991 [ES] Spain ..... 9101636
Mar. 30, 1992 [ES] Spain ..... 9200669

[51] Int. Cl.[5] ..... E04D 13/00; E04D 1/30; E04C 2/00

[52] U.S. Cl. ..... 52/588; 52/533; 52/539; 52/595; 52/542; 52/309.9; 52/802

[58] Field of Search ..... 52/519, 533, 535, 539, 52/588, 802, 809, 595, 309.9, 542

[56] References Cited

U.S. PATENT DOCUMENTS

| | | | |
|---|---|---|---|
| 2,027,292 | 1/1936 | Rockwell | 52/595 |
| 3,508,368 | 4/1970 | Tischuk et al. | 52/588 |
| 3,777,430 | 12/1973 | Tischuk | 52/309.9 |
| 3,987,599 | 10/1976 | Hines | 52/595 |
| 3,998,023 | 12/1976 | Anderson | 52/809 |
| 3,998,024 | 12/1976 | Frandsen | 52/809 |
| 4,123,885 | 11/1978 | Scott | 52/802 |
| 4,186,539 | 2/1980 | Harmon et al. | 52/588 |
| 4,575,981 | 3/1986 | Porter | 52/309.9 |
| 4,744,185 | 5/1988 | Lamberet et al. | 52/588 |

FOREIGN PATENT DOCUMENTS

| | | | |
|---|---|---|---|
| 0396378 | 1/1966 | Switzerland | 52/588 |

*Primary Examiner*—Carl D. Friedman
*Assistant Examiner*—Christopher Kent
*Attorney, Agent, or Firm*—Steinberg & Raskin

[57] ABSTRACT

The present invention includes panels having longitudinal sides configured for lateral engagement of the panels an include a drainage channel hidden by a jut or wing of the panel arranged immediately beside the channel. The channel collects possible infiltrations through joints arranged between the laterally coupled panels. The panels also include a slot at one end and an extension at the other end which, when are coupled together by overlapping and axial sliding. The panels have a space in which a securing staple is arranged to secure the panels to a support structure. The staple is spaced apart from the channel and hidden by the jut of the next lateral panel, so that the securing devices are isolated from the outside. In a preferred embodiment, one of the sides of the panels has a cross section with a smaller cross section than the rest of the panel so that it can be coupled by longitudinal sliding into a slot of complementary form arranged at the other end of the panels. A total watertight seal is obtained without the need to use weather strips and inner seals.

20 Claims, 9 Drawing Sheets

V
VI
19
2b
1
2a
2b
2a
1
1
IV
IV
29
24
19
2b
VI
V

X
XI
118
102a
117
102
101
110
116
104
109
107
106
109
XI
108
X

WATERTIGHT ROOF FOR BUILDINGS AND CONSTRUCTIONS IN GENERAL

The present invention refers to a watertight roof for buildings and constructions in general, which is totally flat, without longitudinal projections and provided with means to ensure the absolute watertightness thereof.

BACKGROUND OF THE INVENTION

Known in the art are facing panels for walls in buildings and constructions in general, formed by two flat metal sheets joined together, one of which forms the internal side of the panel while the other forms the outer side, between which sheets is a chamber filled with material of a heat-insulating nature.

This type of flat panels for covering the outer walls of a building or construction is unsuitable for use as a roof or roofing, for the seals between the elements thereof lack sufficient watertightness.

Another type of roof currently used is made up of channeled panels, that is, panels with their outer side provided with longitudinal projections or drawings, which alternate with channels. These roofs have a disadvantage of an aesthetic order, owing to the presence of the projections, and furthermore their attachment to the support beams or purlins is implemented by means of threaded stems which pass through he panels, the heads of these stems being left on the outer side of the panels, which means that they deteriorate easily through the action of atmospheric agents. Similarly, the joints between the panels, formed by weather strips or beads, can suffer wear over time, therefore allowing possible infiltration of rainwater.

Also known are roofing panels of the type described above, which, once placed on the support structure, are joined to each other by means of a flanging operation, which consists in bending together, one around the other, two longitudinal edges of the sheets which compose the two sides of the panel, in order to achieve their watertight joining together. This operation is carried out once the sheets have been fitted on the support structure, using a portable machine which is complex to operate, so that fitting of this type of roofing is slow and costly.

DESCRIPTION OF THE INVENTION

In order to solve the disadvantages described, the watertight roof for buildings and constructions in general object of the invention was designed, the exterior side of which is flat and presents means for achieving total watertightness thereof.

The roof in question is of the type which comprises at least one panel formed of two sheets, one of which constitutes the exterior side of the panel and the other the interior side. These sheets are linked to each other by a filler material of heat insulating properties. The longitudinal sides of the panel present a complementary configuration of the tongue-and-groove type, for lateral coupling thereof, with interposition of water-tightness seals, to other panels of the same type. Furthermore, the ends of the panel present means for coupling by overlap to identical aligned panels. Said panels are fixed by means of securing devices onto a support structure formed of transversal purlins, while underneath the lower edge of the roof is a collector channel for the water falling on it.

On the basis of this known embodiment, the roof object of the invention is characterized in that one of the longitudinal sides of the panel on the basis of which the roof is constructed presents a longitudinal drainage channel which leads into the water collector channel. This drainage channel is hidden and covered to the upper part, on a longitudinal side complementary to that described, by a piece juxtaposed laterally to the panel, with insertion of a watertightness joint, having the special feature of the joint remaining above the drainage channel, so that the latter collects potential infiltrations of water which might arise through the joint and leads them to the general channel of the roof.

Beside the drainage channel, the lower side of the panel extends laterally forming a wing arranged on a lower plane with respect to the channel. On this wing are provided the means of securing the panel onto the support purlin, which are left outside the inner drainage channel, being covered and hidden by the complementary side of the piece juxtaposed laterally to the panel.

Advantageously, the piece with the side complementary to the side of the panel on which the drainage channel is arranged, is made up of an identical panel whose longitudinal sides are complementary to each other.

One of the ends of the sheet corresponding to the external side of the panels which constitute the roof extends in a longitudinal overlap, designed to be superimposed on the near end of another panel aligned longitudinally next to it. The panel on the basis of which the roof in question is obtained presents on its longitudinal sides some complementary recesses in the form of slots, which lead to the formation of juxtaposition sections which allow mutual slotting together of the aligned panels by longitudinal sliding of same.

The juxtaposition sections of the aligned panels incorporate watertightness joints, the joints of each panel being complementary to those of the panels coupled laterally.

The longitudinal edges of the sheet which constitutes the outer side of the panels presents projecting folds of channelled configuration, forming areas closed on the outside, complementary and tongue-and-grooved for the coupling of the laterally juxtaposed panels. Within the folds are arranged elastic weather strips which project from said folds at the end sections of juxtaposition between aligned panels, so that they constitute watertightness seals juxtaposed with other complementary seals arranged at the end sections of the panel.

In a more specific embodiment, the longitudinal section of the panel situated at the end opposite to that of the channel includes an upper part corresponding to the external side of the panel, forming a jut which projects markedly with respect to the lower part corresponding to the internal side. The lower side of the panel is provided with a longitudinal reinforcement concealed within the heat-insulating filler, which reinforcement takes in at least partially the upper part of the filler material which corresponds to the jut described.

The elastic weather strip fitted in the side opposite to that of the drainage channel of the same panel comes above said drainage channel once the panels have been juxtaposed. This weather strip is provided with a projecting zone which functions as a water break.

One version of the improvements of the invention is characterized in that one of the ends of the panels has a cross section of smaller dimensions that those of the rest of the panel. The opposite end of the panels presents a slot containing no filler material, the inner shape of which is complementary to the outer shape of the end, in order to permit the engagement of the ends of the panels aligned longitudinally by means of insertion of one end into the slot of the next panel.

Besides, the lateral projections of the outer sheet corresponding to the end of smaller cross section than the rest of the panel are flattened so that they may be inserted by longitudinal sliding into the lateral edges of the slot of the next panel.

More specifically, the end of smaller cross section than the rest of the panel presents an upper or outer sheet which narrows to both sides to reduce the width thereof.

In this embodiment the drainage channel presents a part of greater cross section than the rest, so that an equivalent part of the channel arranged beside the slot of the next panel can be inserted within it.

DESCRIPTION OF A PREFERRED EMBODIMENT

Figure 1:
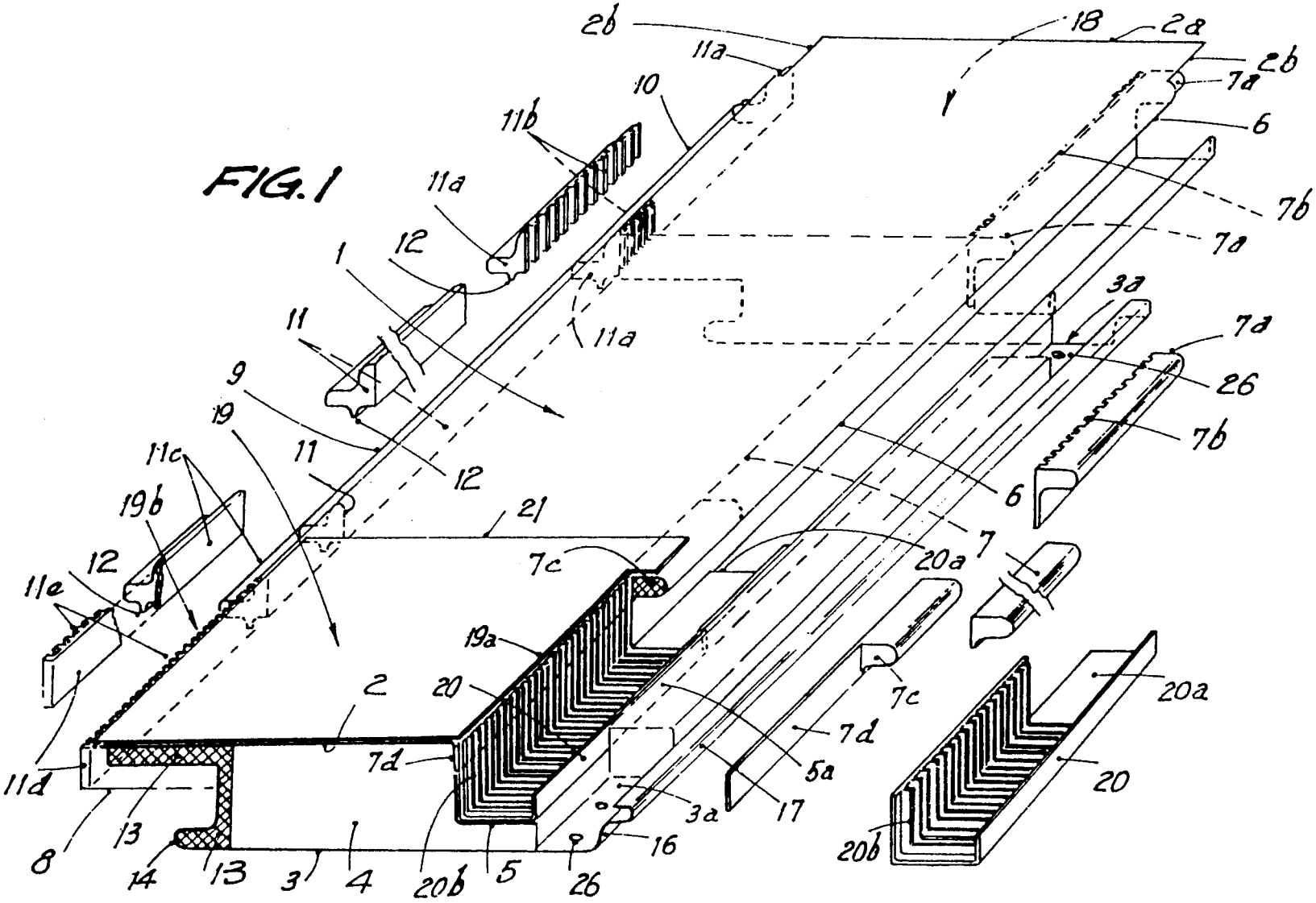
FIG. 1 is a perspective view of a panel forming the roof with the weather strips and seal shown in a correct position and also spaced apart from the panel.

In the example shown in the drawings, the watertight roof is formed by a plurality of panels of general reference -1-, each comprising two metal sheets -2- and -3-, which constitute, respectively, the outer and inner sides of the panel. Between these two sheets is arranged some filler material having suitable heat insulating properties.

On one of its longitudinal sides the sheet -2-presents an inset channel -5-, the bottom of which comes in a position close to the sheet -3-. This channel -5- is partly closed by a projecting piece -6- formed by a bend of the sheet. Inside the channel 5, an elastic weather strip -7- is housed, as will be detailed below, constitutes a tightness seal.

The opposite longitudinal side of the sheet -2- extends in the form of a jutting wing -8-, or simply just which at the longitudinal edge presents a recess -9- having a shape complementary to the projecting piece -6-, and a fold -10-similar to -6-, but on plane lower than the latter, inside of which is arranged an elastic weather strip -11-, with a lower rib -12- in the form of a water break.

The lower side of the jut -8- presents an extension **-4*a*- of the heat-insulating filler -4-, inside which is concealed a rigid reinforcement shape -13-**. It may arise that the very reinforcement may act as heat insulating filler in the event of said reinforcement extending as far as the outer side.

At the longitudinal edge beneath the wing -8-, the sheet -3- presents a fold -14- similar to fold -10-, inside which is placed the rigid reinforcement shape -13-.

At the longitudinal edge opposite the one with the fold -14-, the sheet -3- has a recess -16- similar to recess -9- and, on a higher plane, a fold -17- similar to fold -10-.

One of the ends of the panels -1- presents a slot -18- formed by suppression of a section of the filler material -4- and of a section of equivalent length of the sheet -3-, so that the end of the sheet -2- forms an extension or overlap **-2*a*- which has two lateral cuts -2*b*-, by means of which two lateral zones of said overlap -2*a*-and the ends of folds -6- and -9-** have been eliminated.

The end of the panel -1- opposite that with the slot -18- presents an extension -19- complementary to the slot -18-, in which two lateral slots **-19*a*- and -19*b*- have been formed, leading to elimination of the end sections of folds -6- and -10-, the end sections of weather strips -7-and -11-, a portion of the insulating material -4- arranged between the channel -5- and the fold -17-, and one of the walls -5*a*- of the inset channel -5-**.

At the ends of the folds -6- arranged beside the slot -18- are housed extensions **-7*a*- and -11*a*- of weather strips -7- and -11-, respectively, provided with splines -7*b*- and -11*b*- (FIG. 1). To provide a clearer view of these extensions and of the joints and weather strips to be described below, these are shown in figure of the drawings, both incorporated to the panel -1-** and detached from it.

On the other hand, at the end of the channel -5-placed beside the extension -19- is housed a groove-shaped elastic joint -20- with a wing **-20*a*-, said joint having a splined section -20*b*- complementary to the splined section -7*b*- of the weather strip -7*a*-**.

At the same time, the weather strip -7- at the end of the fold opposite joint -20- has an extension **-7*c*-, with a tab -7*d*- provided behind the joint -20-**.

On the side opposite to that occupied by the extension **-7*c*-, the weather strip -11- has an extension -11*c*- with a wing -11*d*- provided with a splined section -11*e*- complementary to the splined section -11*b*- of the weather strip -11*a*-**.

The set of watertightness joints of the panel -1- is completed by a sheet of elastic material -21- juxtaposed on the extension -19-.

The watertightness joints may be embodied in various ways, though this will not affect the essential characteristics of the invention.

Figure 5:
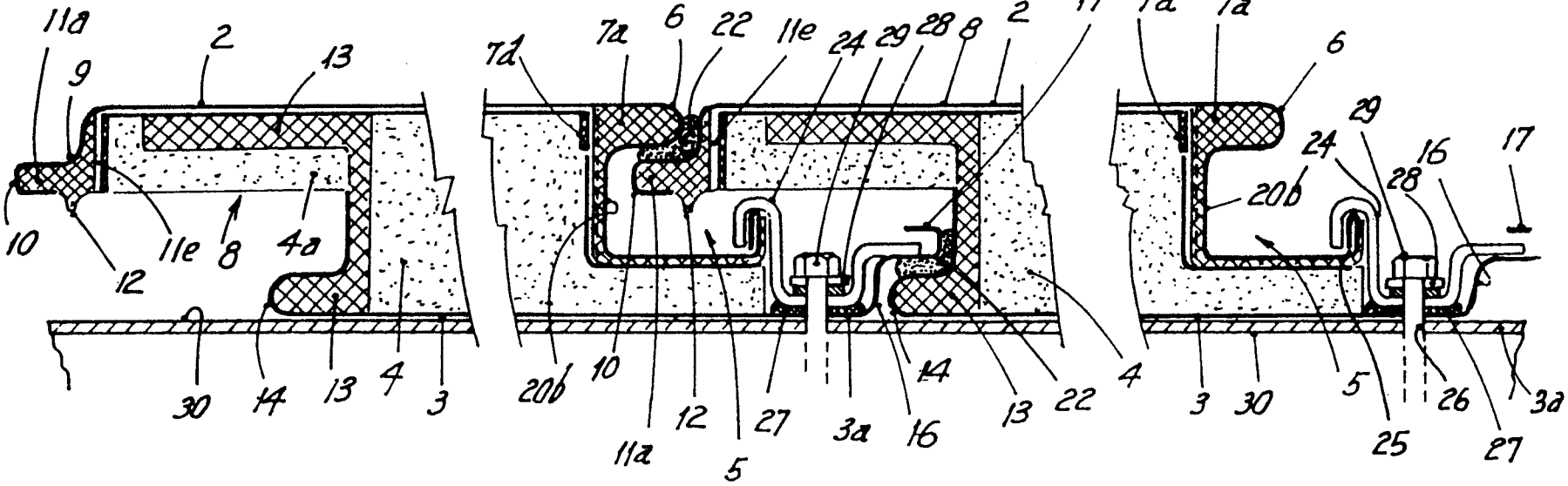
FIG. 5 is a view taken along plane V—V of FIG. 3.
Figure 6:
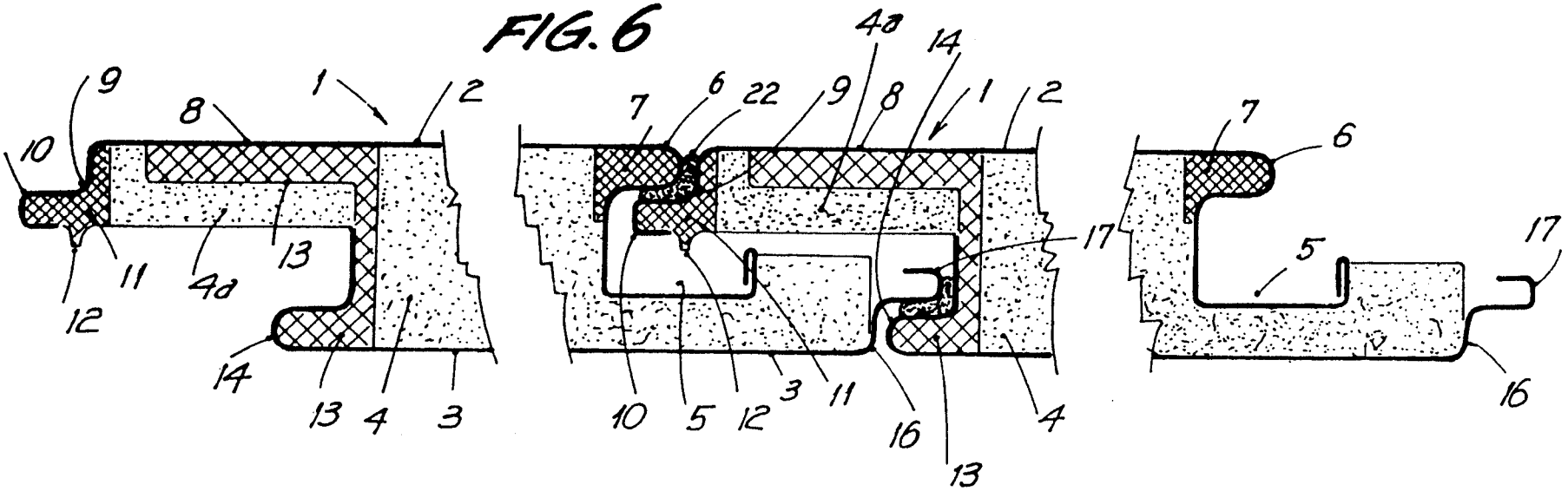
FIG. 6 is a view taken along plane VI—VI of FIG. 3.

The panel -1- described presents its longitudinal sides formed by folds -10-, -14- complementary to the folds of the opposite side -6-, -17-, so that the panels can be slotted together laterally, as illustrated by FIGS. 5 and 6 of the drawings.

Figure 7:
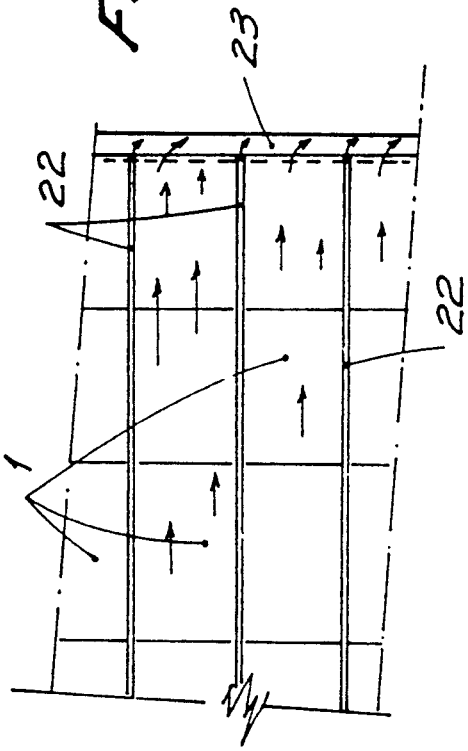
FIG. 7 is a schematic plan detail of a part of the roof showing the running direction of water which falls upon the roof and is oriented toward a general training channel.
Figure 8:
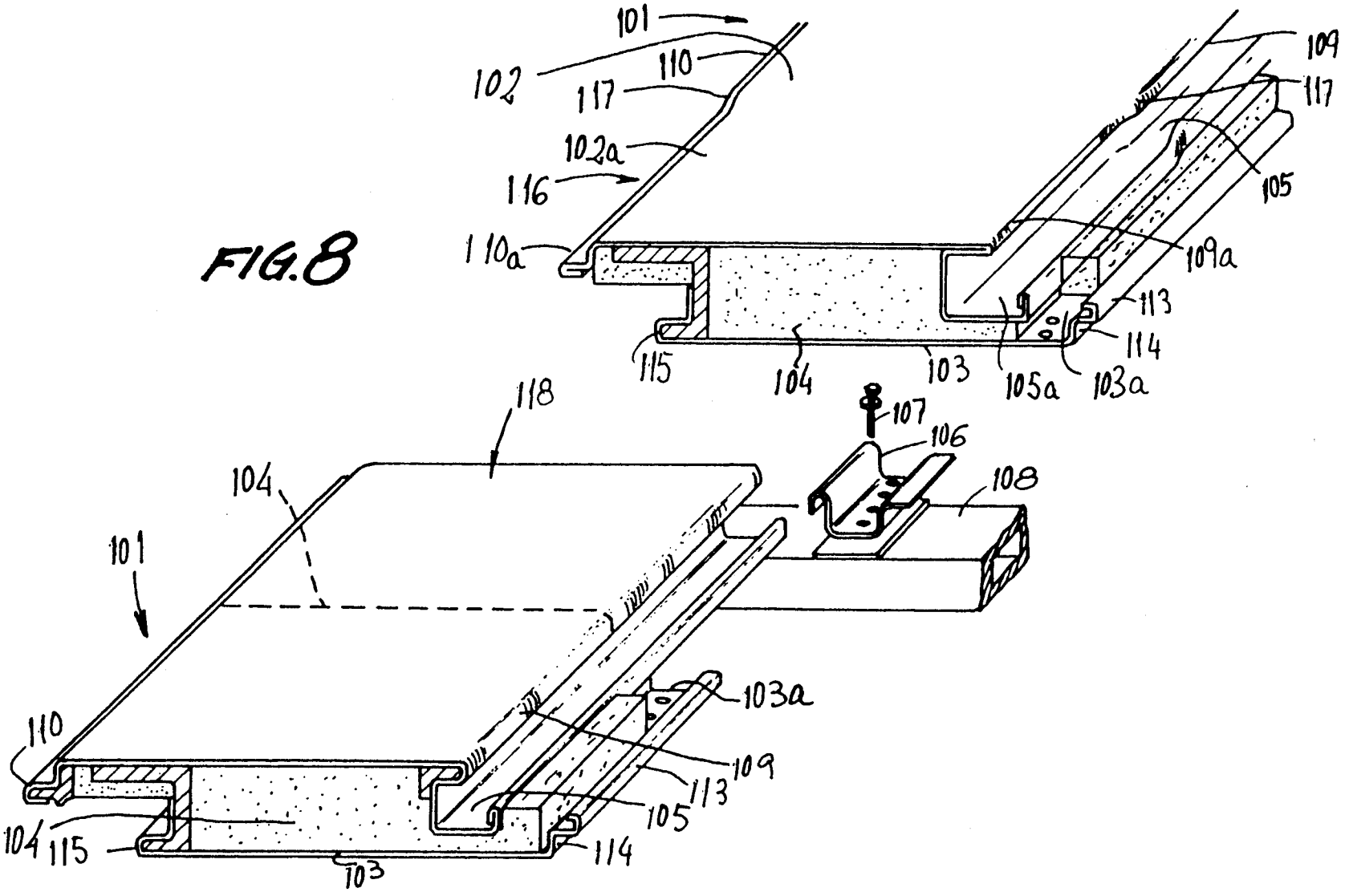
FIG. 8 is a perspective view of another embodiment of the present invention, in which the ends of the panels are inserted inside each other, showing the ends of two panels spaced apart and facing each other for their engagement and also a piece for securing the panels onto one of the support purlins of the roof.
Figure 9:
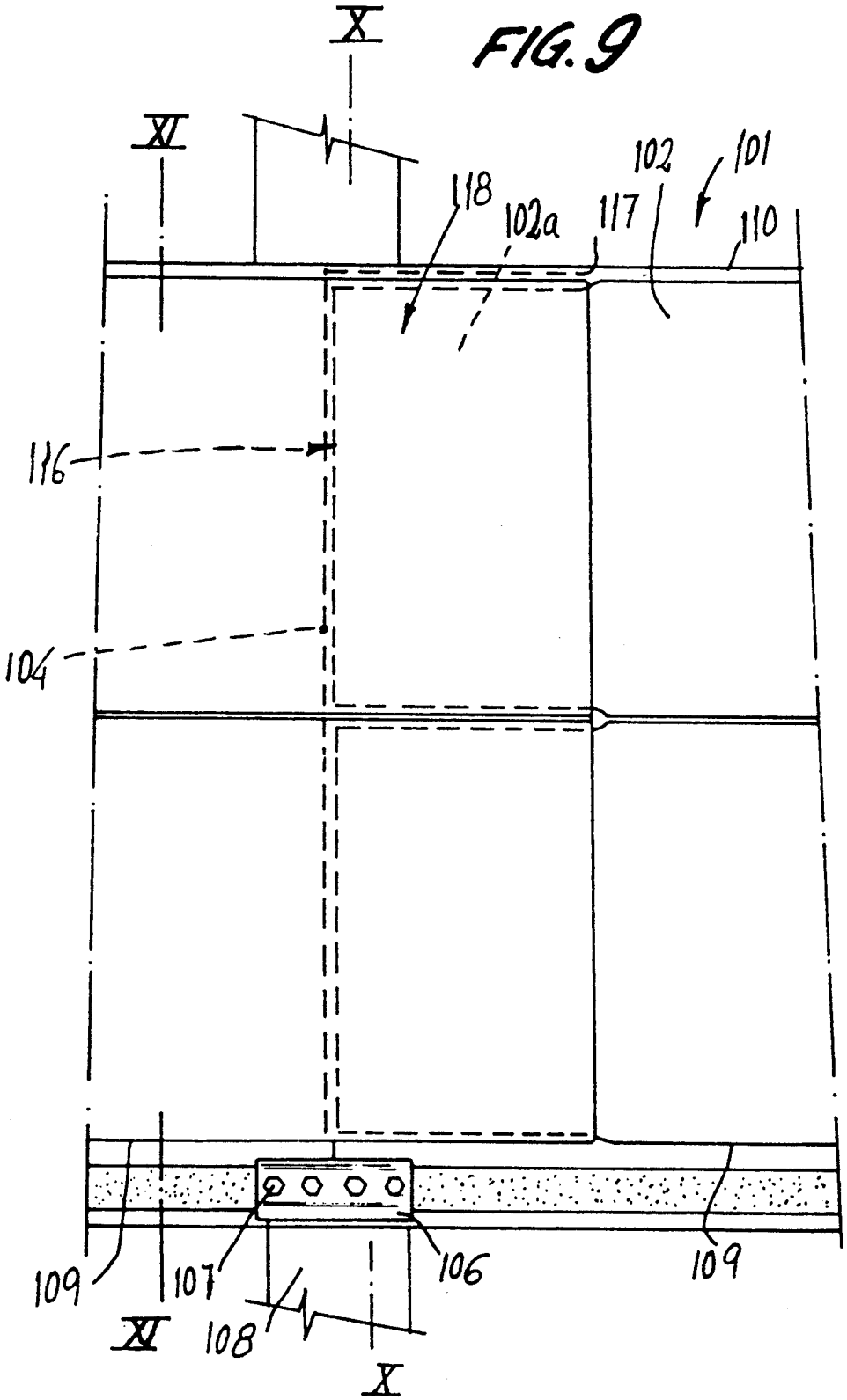
FIG. 9 is a plan view of a part of the roof showing the embodiment of FIG. 8

These figures show clearly that the longitudinal channel -5- is arranged beneath the juxtaposition zone of the upper folds -6- and -10- which, together with recess -9-, form a tongue and groove joint whose watertightness is supplemented by means of a putty -22- of known type. Nevertheless, should there arise any infiltration in the lateral slotting zones of the panels, channel -5- collects this water and leads it to a general channel -23- of known type arranged on the edge of the roof (FIG. 7).

The panel -1- presents its ends formed, respectively, by the slot -18- and the extension -19-, complementary to each other, for juxtaposition thereof by means of longitudinal displacement of one panel with respect to the next one beside it, in such a way that the extension 19 is inserted into the slot -18-.

On coupling the panels by their ends the splined surfaces -20*b*-, -7*b*- of the joints -20- and -7*a*-, on the one hand, and the splined surfaces -11*e*- and -11*b*- of the weather strips -11*d*- and -11*a*-, on the other, are juxtaposed. At the same time, the projecting ends of the weather strips -7*a*- and -11*a*- rest head on at the ends of weather strips -7*c*- and -11*c*-, respectively. The sheet -21- constitutes a supplement for leveling and improving the watertightness of the panel end coupling.

Figure 2:
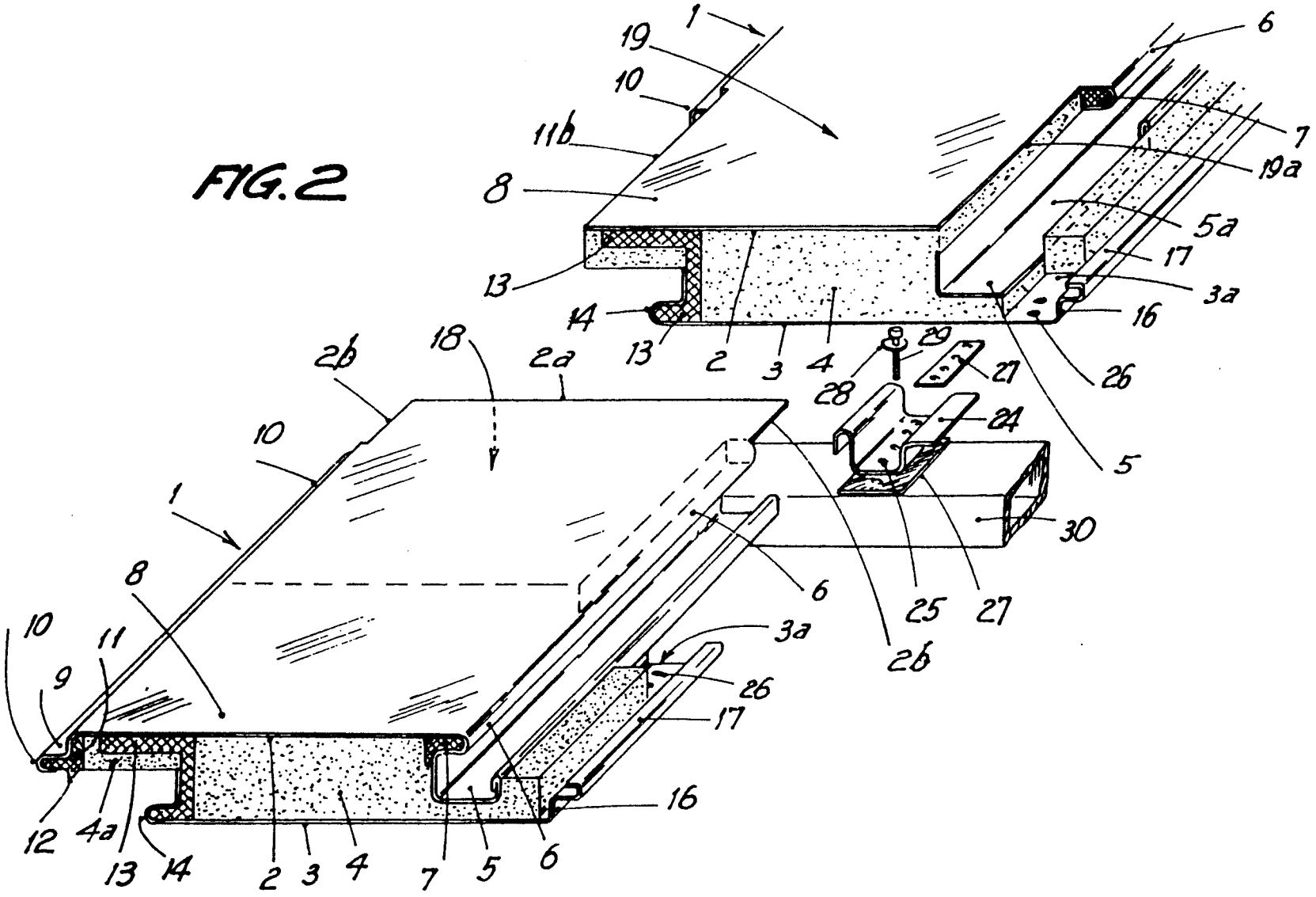
FIG. 2 is a perspective view of two panels spaced apart in accordance with the present invention.
Figure 3:
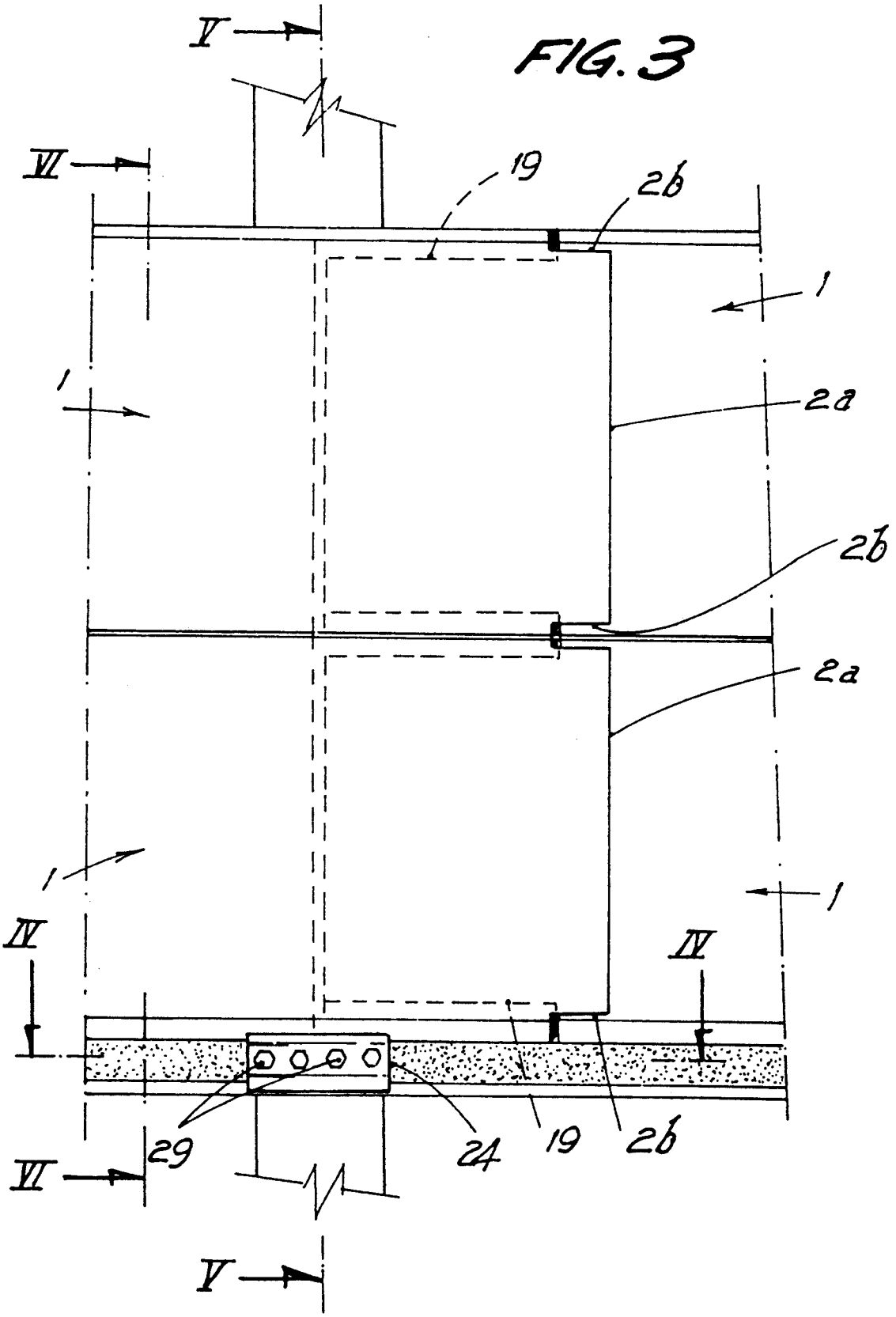
FIG. 3 is a plan view of a roof section in accordance with the invention.
Figure 4:
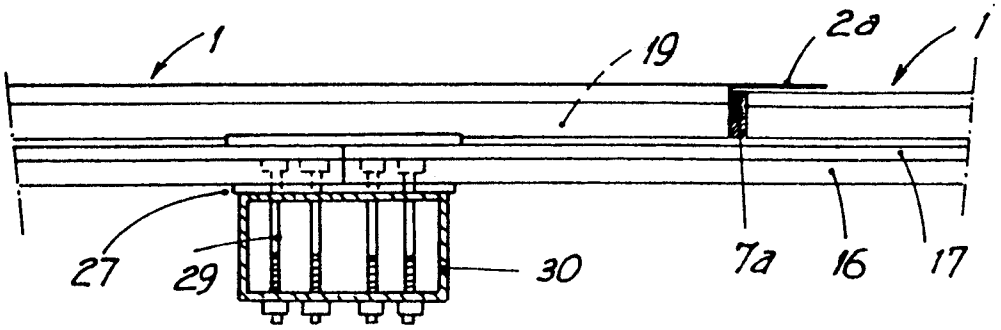
FIG. 4 is a view taken along plane IV—IV of FIG. 3.

For fixing the roof panels -1- in working position, staples -24- have been provided, having orifices -25- coinciding with other orifices -26- provided on a zone -3*a*- of the internal sheet -3-, on which the insulating filler material -4- has been eliminated (FIGS. 1, 2 and 5). The staple is supplemented by a small elastic plate -27- intended to ensure watertightness of the coupling zones, and by bolts -29-, with watertight washers -28-, used for securing the staples onto roof support purlins -30-.

As can be appreciated from FIG. 5 of the drawings, it is important to note that the zone at which the staples -24- are arranged is underneath the jut -8- of each panel -1-, perfectly isolated from the outside and from the drainage channel -5- itself.

In spite of its being formed by flat panels, the roof described has the advantage of achieving total watertightness, as well as protection of the means of securement used to fix it to the support structure. This is due mainly to the presence of the hidden channels -5- and the hidden location of the staples -24-, separate from the channels.

At the same time, the special configuration of the longitudinal sides of the panels and of their ends facilitates their coupling as well as the assembly of the roof, achieving solid retention and watertightness, without the need to carry out special flanging operations on the sheets during fitting of the panels.

In an improved version of the roof object of the invention, shown in FIGS. 8 to 13 of the drawings, the roof comprises a plurality of panels, of general reference -101-, each of which comprises two metal sheets -102- and -103-, which constitute, respectively, the outer and inner sides of the panel. Heat-insulating filler material -104-is inserted between the two sheets.

The sheet -102- of the panels is provided with a drainage channel -105-. The sheet -103- presents a zone -103*a*- which lacks filler material -104-, for the fitting of staples -106- which, by means of bolts -107-, secure the coupled panels onto roof support purlins -108-.

The channel -105- is partly closed by a projecting edge -109- formed by a round-edged fold of the sheet -102- itself. This sheet presents a projecting edge -110-on the opposite side to the edge -109- and on a lower plane than same, formed by a round-edged fold which, together with the edge -109-, constitutes a tongue-and-groove lateral coupling device for the panels. Within this fold is arranged a weather strip -111- with a lower lip -112- which constitutes a water break device.

One of the sides of the sheet -103- has a projecting edge -113-, formed by a fold with a recess -114-. On the opposite side of the sheet there is a projecting edge -115- which is complementary with respect to the recess -114-, and they form between them a tongue-and-groove device for lateral coupling of the panels Thus far the described characteristics of the panels -101- coincide with those set forth and shown in FIGS. 1 to 7 of the drawings.

The characteristics of the improved roof consist in the upper or external sheet -102- of one of the ends -116- of the panels -101- presenting narrowed sections -117- on both sides, which leads to a reduction of the cross section of that end.

The end -116- presents a flattened extension -109*a*- of the edge -109- and a similarly flattened extension -110*a*- of the edge -110-, for the purposes of coupling between two consecutive panels, which will he described below.

Furthermore, the end -116- of the panels -101-presents an extension -105*a*- of the drainage channel -105-, of greater outline than that of the rest of the channel, so that an equivalent section of channel -105- of the end of the next panel can be introduced within it.

The panels -101- present one end -118- opposite to -116-, which has the special feature that, as in the case of the embodiment shown in FIGS. 1 to 7 of the drawings, it forms a slot which has no filler material -104-, although, unlike the previous embodiment, the slot -118- has no overlap extension over the end of the panel to which it is coupled longitudinally.

Figure 13:
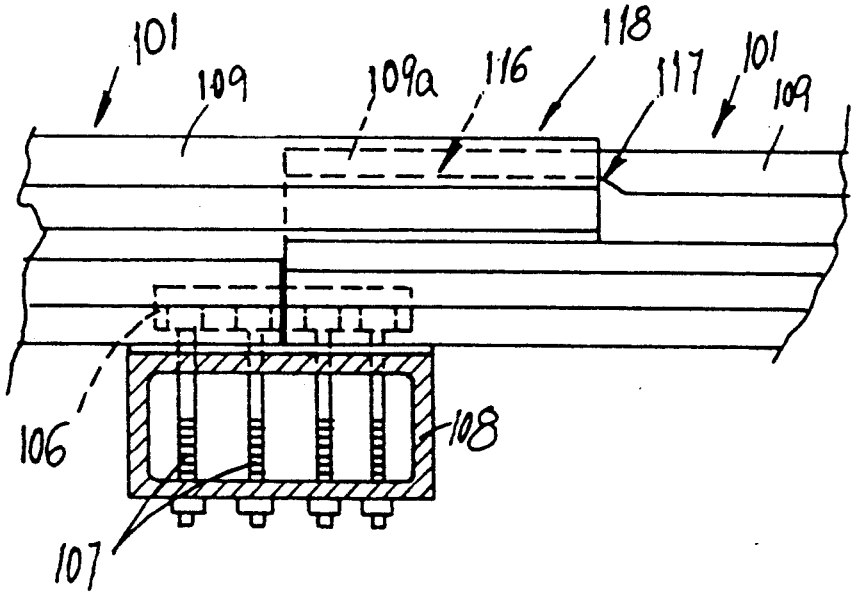
FIG. 13 is a view similar to that shown in FIG. 12 showing the ends of the panels coupled together and secured onto a roof support purlin.

As may be deduced from all that has been set forth and from observation of the drawing, the longitudinal coupling of the panels -101- is carried out by moving one of the panels longitudinally towards the other (figure so that the end -116- of one of them is inserted into the slot -118- of the other (FIG. 13). This is possible as a result of the width reduction of the end -116-is with respect to the slot -118-, the flattening of the edges -109*a*- and -110*a*- and the increased width of section -105*a*- of the drainage channel. These elements slide inside the complementary elements -109- and -110- of the slot -118- and outside the channel -105- immediately beside said slot, respectively.

Figure 10:
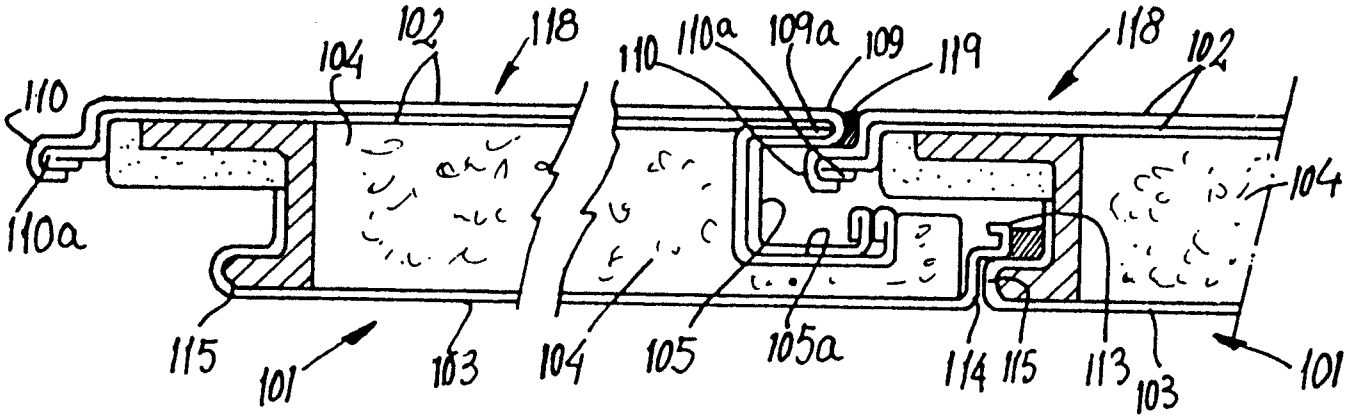
FIG. 10 is an enlarged scale detail of a cross section of the roof taken along plan X—X of FIG. 9.
Figure 11:
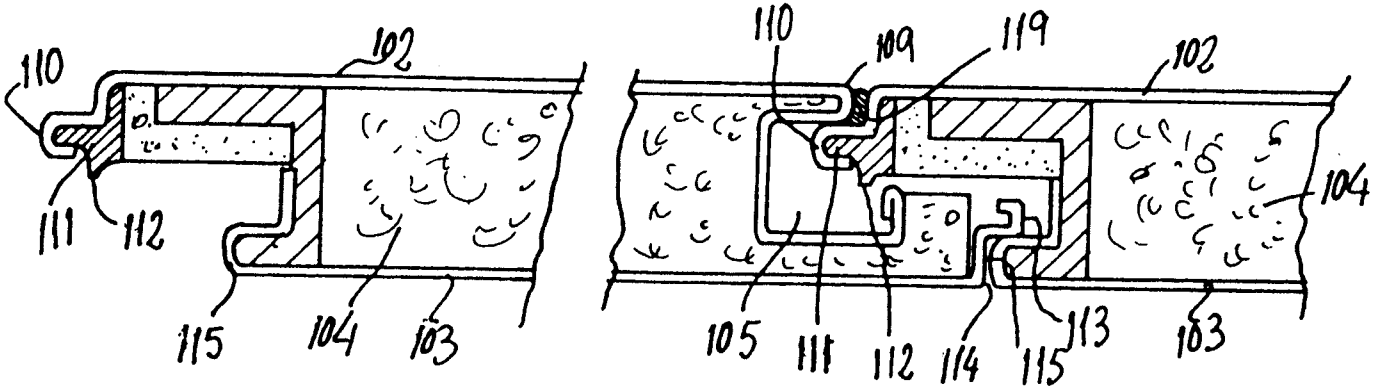
FIG. 11 is an enlarged scale detail of a cross section of the roof taken along plane XI—XI of FIG. 9.
Figure 12:
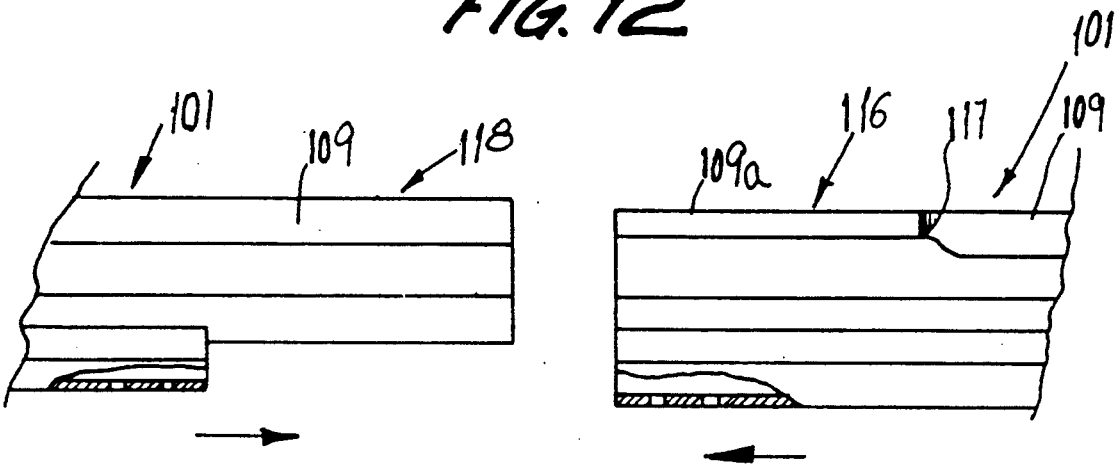
FIG. 12 is a side elevation view of the ends of two panels about to be coupled together in accordance with the embodiment as shown in FIG. 8.

This embodiment allows elimination of a plurality of tightness seals and weather strips, necessary in the embodiment shown in figures I to 7 of the drawings, thereby reducing the costs of the panels and of the roof. Watertightness of the roof is achieved by applying a sealing joint -119- of conventional type to the coupling zone between the edges -109- and -110- (FIGS. 10 and 11).

Independent of the object of the invention shall be the materials used in manufacturing of the roof elements, their shapes and dimensions and all accessory details which might be presented, as long as they do not affect its essential nature.

I claim:

1. In a panel of a substantially watertight roof construction including a water collector channel arranged underneath a lower edge of the roof and a plurality of said panels, each panel having inner and outer sides and a heat-insulating filler material interposed between them, said panel having first and second opposing longitudinal sides and first and second opposing transverse sides, adjacent longitudinal sides of transversely adjacent panels having a tongue and groove construction with an interposed water seal for coupling said transversely adjacent panels to each other, and means for coupling longitudinally adjacent panels to each other, the improvement comprising a longitudinal drainage channel arranged on said first longitudinal sides of said panel and directed toward the water collector channel, first transverse coupling means arranged on said first latitudinal side of said panel, second transverse coupling means arranged on said second longitudinal side of said panel, said first transverse coupling means for coupling said first longitudinal side of said panel to second transverse coupling means on a second longitudinal side of a first adjacent panel situated adjacent to said first longitudinal side, said second transverse coupling means for coupling said second longitudinal side of id panel to first transverse coupling means on a first longitudinal side of a second adjacent panel situated adjacent to said second longitudinal side, said second transverse coupling means comprising a first projecting edge structed and arranged to substantially cover a drainage channel on said first longitudinal side of said second adjacent panel to thereby form a tongue and grove type coupling arrangement having a seal between said first projecting edge and said first longitudinal side of said second adjacent panel, said longitudinal coupling means being arranged on said first and second transverse sides of said panel to provide an overlap to connect said panel to third and fourth longitudinally adjacent panels, respectively, and securing means for securing said panel to a support structure of the roof having transverse purlins.

2. The watertight roof of claim 1, wherein an inner side of said panel extends laterally to form a wing on said first longitudinal side of said panel, said wing being arranged at a height level on said first longitudinal side which is lower than a height level of said drainage channel on said panel, said securing means being arranged on said wing outside of said drainage channel and being substantially covered by said second transverse coupling means.

3. The watertight roof of claim 1, wherein said first adjacent panel and said second adjacent panel are substantially identical to said panel.

4. The watertight roof of claim 1, wherein said longitudinal coupling means comprise a slot arranged at said first transverse side of said panel and an extension arranged at said second transverse side of said panel, said slot and said extension having corresponding recesses formed therein, said slot on said panel being structure dan arranged to receive a corresponding extension on said third adjacent panel and said extension on said panel being structured and arranged to slide into a corresponding slot on said fourth adjacent panel to thereby provide a formation of a juxtaposition of longitudinally coupled panels.

5. The watertight roof of claim 4, further comprising watertight joints arranged in said recesses of said slot and said extension of said panel and in between the adjacent, longitudinally coupled panels.

6. The watertight roof of claim 1, further comprising a first and second projecting fold arranged on said first and second longitudinal sides of said panel, respectively, on each of said first and said second sheet, said folds having a channelled shape and forming enclosed areas such that said folds are closed in an outward friction, said first projecting fold on said first sheet aligning with a corresponding second projecting fold on a first sheet of said first adjacent panel and said first projecting fold on said second sheet aligning with a corresponding second projecting fold on a second sheet of said second adjacent panel, and elastic weather strips arranged in said folds, said strips projecting from said folds at said first and second transverse sides of said panel which connect to said third and fourth adjacent panels, whereby said strips constitute watertight seals aligned with corresponding elastic weather strips arranged at transverse sides of said third and fourth adjacent panels.

7. The watertight roof of claim 1, wherein said first projecting edge comprises an upper part of said second longitudinal side of said panel and extends over a lower part of said second longitudinal side of said panel, a portion of said upper part and said lower part having an enclosed area filled with reinforcement material adjacent to said filler material.

8. The watertight roof of claim 1, further comprising elastic weather strips arranged in said first projecting edge, said weather strip having a projecting zone functioning as a water break such that water drains into the drainage channel on the adjacent panel.

9. The watertight roof of claim 6, wherein said strips are splined on an end thereof facing said panel and said longitudinal coupling mean comprises splined surfaces arranged around said drainage channel such that said strips and said splined surfaces are juxtaposed when said third and forth adjacent panels are longitudinally coupled to said panel.

10. The watertight roof of claim 1, wherein said longitudinal coupling means comprise a firs end of said panel being an extension end having a smaller cross sectional area than a remaining portion of said panel, and a second end of said panel opposite to said extension end being a slot end having an opening therein, the shape of said opening in said slot end corresponding to the shape of said extension end, whereby said panel is coupled to the third and fourth adjacent panel such that said extension end of said panel is receivable in a slot end of the third adjacent panel and said slot end of said panel receives an extension end of the fourth adjacent panel.

11. The watertight roof of claim 1, wherein said first transverse coupling means comprise a second projecting edge arranged on said first longitudinal side of said panel partially over said drainage channel, and a sealing joint arranged between said second projecting edge and a first projecting edge of said first adjacent panel to thereby form a tongue and groove type coupling arrangement having a seal between said panel and said first adjacent panel.

12. The watertight roof of claim 10, wherein said first transverse coupling means further compressive a second projecting edge arranged on said first longitudinal side of said panel, said first projecting edge and said second projecting edge of said panel having a smaller cross-sectional area at said extension end of said panel, whereby said panel is coupled to the third adjacent panel such that said first projecting edge and said second projecting edge are receivable in a corresponding first and second projecting edge, respectively, of a slot end of the third adjacent panel.

13. The watertight roof of claim 10, wherein said extension end has a smaller cross sectional area than said slot end, said smaller area of said extension end being formed from a narrowing on both longitudinal sides of said panel.

14. The watertight roof of claim 10, wherein said drainage channel has an enlarged area t said extension end of said panel such that a channel of the third adjacent panel is insertable in said drainage channel of said panel.

15. The watertight roof of claim 1, wherein said securing means comprise staples arranged in a portion of said second sheet, and bolts for securing said stapes to the purlins.

16. The watertight roof of claim 1, wherein said first projecting edge is formed from a round-edged fold of said first sheet.

17. The watertight roof of claim 11, wherein said first projecting edge is arranged at a height level on said panel which is lower than a height level of said second projecting edge such that said second projecting edge is situated over said sealing joint int the coupling arrangement and said first projecting edge is situated below said sealing joint in the coupling arrangement.

18. The watertight roof of claim 12, wherein said second projecting edge is arranged at an upper edge of said first longitudinal side of said panel on said first sheet and said first projecting edge is arranged on an upper edge of said second longitudinal side of said panel on said first sheet.

19. The watertight roof of claim 18, wherein said first transverse coupling means further comprise a third projecting edge arranged at a lower edge of said first longitudinal side and a fourth projecting edge arranged at a lower edge of said second longitudinal side, said third projecting edge having a recess formed therein such that a corresponding fourth projecting edge of said first adjacent panel is received in said recess to thereby form a tongue and groove coupling arrangement between said first adjacent panel and said panel.

20. The watertight roof of claim 19, wherein said third and fourth projecting edges are arranged on said second sheet.

* * * * *